US007555908B2

(12) United States Patent
Bin-Nun

(10) Patent No.: US 7,555,908 B2
(45) Date of Patent: Jul. 7, 2009

(54) CABLE DRIVE MECHANISM FOR SELF TUNING REFRIGERATION GAS EXPANDER

(75) Inventor: Uri Bin-Nun, Chelmsford, MA (US)

(73) Assignee: FLIR Systems, Inc., Wilsonville, OR (US)

( * ) Notice: Subject to any disclaimer, the term of this patent is extended or adjusted under 35 U.S.C. 154(b) by 480 days.

(21) Appl. No.: 11/432,957

(22) Filed: May 12, 2006

(65) Prior Publication Data

US 2007/0261417 A1 Nov. 15, 2007

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS

| | | | | |
|---|---|---|---|---|
| 3,742,719 | A | 7/1973 | Lagodmos | |
| 4,024,727 | A | 5/1977 | Berry et al. | |
| 4,231,418 | A | 11/1980 | Lagodmos | |
| 4,365,982 | A * | 12/1982 | Durenec | 62/6 |
| 4,475,346 | A | 10/1984 | Young et al. | |
| 4,505,119 | A | 3/1985 | Pundak | |
| 4,514,987 | A | 5/1985 | Pundak et al. | |
| 4,550,571 | A | 11/1985 | Bertsch | |
| 4,574,591 | A | 3/1986 | Bertsch | |
| 4,588,026 | A | 5/1986 | Hapgood | |
| 4,711,650 | A | 12/1987 | Faria et al. | |
| 4,846,861 | A | 7/1989 | Berry et al. | |
| 4,858,442 | A | 8/1989 | Stetson | |
| 4,862,695 | A * | 9/1989 | Kushnir | 62/6 |
| 4,922,722 | A * | 5/1990 | Kazumoto et al. | 62/6 |
| 4,967,558 | A | 11/1990 | Emigh et al. | |
| 5,076,058 | A | 12/1991 | Emigh et al. | |
| 5,197,295 | A | 3/1993 | Pundak | |
| 5,535,593 | A * | 7/1996 | Wu et al. | 62/6 |
| 5,596,875 | A * | 1/1997 | Berry et al. | 62/6 |

(Continued)

FOREIGN PATENT DOCUMENTS

| | | |
|---|---|---|
| EP | 0 778 452 | 12/1996 |

(Continued)

*Primary Examiner*—William C Doerrler
(74) *Attorney, Agent, or Firm*—The H. T. Than Law Group; Edward Kelley

(57) ABSTRACT

A refrigeration device includes a gas displacing piston (362) movable within a gas expander cylinder (364). The volume of a gas expansion space (362) is varied as the gas displacing piston (362) is moved over an expansion stroke range. The device includes a compression spring (622) disposed to bias the gas displacing piston (362) toward a compression stroke top end position (85). A cable element (606) extends into the gas expansion cylinder (364) and attaches to the gas displacing piston (362). A motive drive device (302) applies a tensioning force to the cable (606) and the tension force opposes the spring biasing force and moves the gas displacing piston (362) to a compression stroke bottom end position (83). In a further embodiment the expansion stroke is self-tuning when a pneumatic force generated by refrigeration gas contained within the expansion space (362) exceeds a threshold gas pressure and the pneumatic force overcomes the spring biasing force and pneumatically forces the gas displacing piston (362) to the bottom end position (83).

18 Claims, 7 Drawing Sheets

U.S. PATENT DOCUMENTS

| | | | | |
|---|---|---|---|---|
| 5,638,684 | A | 6/1997 | Siegel et al. | |
| 5,647,217 | A | 7/1997 | Penswick et al. | |
| 5,735,128 | A | 4/1998 | Zhang et al. | |
| 5,775,109 | A | 7/1998 | Eacobacci, Jr. et al. | |
| 5,822,994 | A | 10/1998 | Belk et al. | |
| 5,895,033 | A | 4/1999 | Ross et al. | |
| 6,050,092 | A | 4/2000 | Genstler et al. | |
| 6,065,295 | A | 5/2000 | Hafner et al. | |
| 6,070,414 | A | 6/2000 | Ross et al. | |
| 6,094,912 | A | 8/2000 | Williford | |
| 6,144,031 | A | 11/2000 | Herring et al. | |
| 6,167,707 | B1 | 1/2001 | Price et al. | |
| 6,256,997 | B1 | 7/2001 | Longsworth | |
| 6,327,862 | B1 | 12/2001 | Hanes | |
| 6,397,605 | B1 | 6/2002 | Pundak | |
| 6,532,748 | B1 | 3/2003 | Yuan et al. | |
| 6,595,006 | B2 | 7/2003 | Thiesen et al. | |
| 6,595,007 | B2 | 7/2003 | Amano | |
| 6,701,721 | B1 | 3/2004 | Berchowitz | |
| 6,778,349 | B2 | 8/2004 | Ricotti et al. | |
| 6,779,349 | B2 | 8/2004 | Yoshimura | |
| 6,809,486 | B2 | 10/2004 | Qiu et al. | |
| 6,886,348 | B2 | 5/2005 | Ogura | |
| 6,915,642 | B2 | 7/2005 | Ravex | |
| 2004/0055314 | A1* | 3/2004 | Shimizu et al. | 62/6 |
| 2005/0223715 | A1* | 10/2005 | Kim | 62/6 |
| 2007/0261419 | A1* | 11/2007 | Bin-Nun et al. | 62/6 |

FOREIGN PATENT DOCUMENTS

| | | |
|---|---|---|
| FR | 2 733 306 | 4/1995 |
| FR | 2 741 940 | 12/1995 |

* cited by examiner

CABLE DRIVE MECHANISM FOR SELF TUNING REFRIGERATION GAS EXPANDER

CROSS REFERENCE TO RELATED APPLICATIONS

The present invention is related to co-pending and co-assigned U.S. patent applications:

Ser. No. 11/433,376, entitled MINIATURIZED GAS REFRIGERATION DEVICE WITH TWO OR MORE THERMAL REGENERATOR SECTIONS, by Uri Bin-Nun, filed even dated herewith;

Ser. No. 11/433,697, entitled COOLED INFRARED SENSOR ASSEMBLY WITH COMPACT CONFIGURATION, by Bin-Nun et al., filed even dated herewith;

Ser. No. 11/433,689, entitled FOLDED CRYOCOOLER DESIGN, by Bin-Nun et al., filed even dated herewith;

the entirety of each of which is incorporated herein by reference.

BACKGROUND OF THE INVENTION

1. Field of the Invention

The invention provides a device and method for driving a gas displacing piston during the expansion stage of a gas refrigeration cycle. In particular, a tensioning device lifts the piston to a bottom end position during the expansion stage and a compression spring biases the piston to a top end position during other stages of the refrigeration cycle. Alternate embodiments of the invention may utilize pneumatic forces generated by the refrigeration gas to overcome the spring biasing force during the expansion stage to self tune the expansion stage.

2. Description of Related Art

Refrigeration devices based on gas refrigeration cycles are known and commercially available. Such devices include a gas compression unit, or compressor, and a gas volume expansion unit, or expander. The compressor and expander are interconnected by a fluid conduit. The combined internal volume of the compressor, expander and fluid conduit provides a working volume filled with pressurized refrigeration gas. Generally the compressor comprises a compression piston movably supported within a compression cylinder and the expander comprises a gas displacing piston movable supported within an expansion cylinder.

A motive drive force is delivered to the compression piston to reciprocally move the piston over a compression stroke during each refrigeration cycle. Each compression stroke generates a once per cycle peak gas pressure amplitude pulse. The compression stroke forces refrigeration gas through the gas expansion piston and into an expansion space formed in the expander. An expansion stroke moves the gas displacing piston to increase the volume of the gas expansion space approximately synchronously with the occurrence of each peak gas pressure amplitude pulse. The rapid expansion of the gas volume inside the expansion space generates cooling power. The expansion device is said to be tuned when the expansion stroke is initiated synchronously with occurrences of the peak gas pressure amplitude pulses inside the expansion space. A tuned expansion device operates at peak efficiency generating a maximum available cooling power.

Generally, the end of compression stroke minimizes the refrigeration working volume and this condition should correspond with peak pressure pulses of the refrigeration gas throughout the working volume. However in practical systems the peak gas pressure amplitude inside the expansion space may not coincide with the end of the compression stroke such that expansion space pressure amplitude peaks may lead or lag the end of the compression stroke. Moreover, the lead or lag may vary from device to device, may change over time as the device wears and may vary in accordance with operating state of the device, e.g. the lead or lag may be different during the cool down stage. Accordingly many refrigeration devices operated with the expansion device not tuned and therefore inefficiently.

This is especially true in mechanical expander drive systems that mechanically link to the gas displacing piston and apply a continuous driving forces to gas displacing piston over the entire expansion stroke. Such systems are designed with a fixed phase relationship between the compression stroke and the expansion stroke. While mechanical expander drives may provide tuned operating conditions early in the useful life of the device, the tuning tends to degrade as the device wears. Generally mechanical linkage expander drive systems are not self-tuning and can not adapt to changing conditions. However, one advantage of a mechanical expander drive system is that its drive frequency may be varied in order to increase or decrease the cooling power generated with substantially changing the efficiency of the refrigeration device.

Specific examples of commercially available cryocooler configured with mechanical expander drives include the FLIR Systems Inc. models MC-3 and MC-5, manufactured in Billerica Mass., and the Ricor Corporation models K560 and K548 manufactured in Israel. Other examples of integrated cryocooler configurations are disclosed in U.S. Pat. No. 3,742,719 by Lagodmos entitled CRYOGENIC REFRIGERATOR, published on Jul. 3, 1973, and in U.S. Pat. No. 4,858,442 by Stetson entitled MINIATURE INTEGRAL STIRLING CRYOCOOLER, published on Aug. 22, 1989 and commonly assigned with the present application.

Pneumatic drive systems are also known for driving a gas expander piston. Specifically a pneumatic drive system includes a displacer piston movably disposed within a spring volume with the displacer piston rigidly connected to the gas displacing piston by a connecting rod so that the displacer and gas displacing piston move in unison. The spring volume comprises a sealed volume filled with pressurized refrigeration gas in fluid communication with the compressor and the gas pressure inside the spring volume fluctuates between maximum pressure amplitude and minimum pressure amplitude approximately synchronous with the compression stroke. The combined displacer piston and gas displacing piston comprise a piston mass supported for harmonic movement with respect to the spring volume and the gas expansion cylinder. Cycled pneumatic pressure fluctuations in the spring volume provide a harmonic excitation force that drives the movement of the piston mass. Movement of the piston mass is damped by mechanical friction between moving and non-moving surfaces and by fluid drag. As in any single degree of freedom harmonic mass/spring/damping system, the piston mass moves with a natural resonant frequency.

Generally, when a pneumatic expander drive is driven at the natural resonant frequency of the piston mass the expander will self-tune. While this has the advantage that a pneumatically driven expander operates efficiently during steady state operation, there are some disadvantages. In particular, practical expander units have natural frequencies above 50 Hz and devices operated above 50 Hz are audibly noisy. Moreover, during non-steady state operation, e.g. during cool down, the device is usually not tuned and uncontrolled movement of the piston mass is noisier and may cause system damage thereby reducing the reliability of the system.

It is known in pneumatic drive systems to incorporate a mechanical compression spring inside a gas expansion cylinder at one or both ends of the expansion cylinder. Such a compression spring tends to quiet operation and prevent system damage during non-steady state operating periods by absorbing shock energy at one or both ends of the piston travel. However, the use of springs inside the gas expansion cylinder adds dead volume to the expansion cylinder and the dead volume is not usable to generate cooling power. As a result, these systems produce less cooling power per unit of input electrical power to the compressor.

It is also know to incorporate mechanical compression springs inside the spring volume, (see Berry et al. U.S. Pat. No. 5,596,875), to alter the natural frequency of the piston mass. This technique also reduces audible noise and prevents system damage during non-steady state operating periods by absorbing shock energy at one or both ends of the piston travel, but without adding dead volume to the expansion cylinder.

Specific examples of commercially available refrigeration devices configured with pneumatic expander drives include the model LC 1055, offered by CARLETON technologies with headquarters in Orchard Park N.Y., and the model BEI/B512 offered by CMC Electronics of Cincinnati Ohio. Other examples of split refrigeration devices are disclosed in U.S. Pat. No. 5,596,875 by Berry et al., entitled SPLIT STIRLING CYCLE CRYOCOOLER WITH SPRING-ASSISTED EXPANDER, published on Jan. 28, 1997, and in U.S. Pat. No. 4,711,650 by Faria et al. entitled SEAL-LESS CRYOGENIC EXPANDER, published on Dec. 8, 1987.

Generally there is a need in the art to provide an expansion drive that is self-tuning, like a pneumatic drive system, operable at a drive frequency that is below 50 Hz to reduce audible noise and operable over a range of drive frequencies while remaining self-tuning.

BRIEF SUMMARY OF THE INVENTION

The present invention overcomes the problems cited in the prior by providing a novel gas refrigeration device operating on a gas refrigeration cycle. The device includes a gas expansion cylinder (364) formed to receive a gas displacing piston (362) movably supported within the cylinder. The cylinder has an open warm end for receiving the displacing piston therein and an opposing sealed cold end. A base element (616) is disposed over the open warm end and the base element includes an aperture (618) passing through it. The aperture provides access into the gas expansion cylinder (364).

The gas expansion cylinder includes a gas expansion space (380) formed at the cold end between the gas displacing piston (362) and the sealed cold end. The expansion space (380) receives refrigeration gas therein through the gas displacing piston (362) which forms a fluid conduit. The volume of the gas expansion space (380) is variable in accordance with movement of the gas displacing piston (362) and varies from a minimum volume when the gas displacing piston is at a top end (85) of the expansion stroke motion range (84) and a maximum volume when the gas displacing piston (362) is at a bottom end position (83).

A compression spring (622) is disposed between the base element (616) and the gas displacing piston (362) and exerts a spring biasing force against the gas displacing piston (362). The spring biasing force acts against the gas displacing piston (362) and biases its position toward the expansion stroke top end (85) where the volume of the gas expansion space (380) is a minimum. In addition, a tensioning element (606) such as a braided metal cable or other tensioning member passes through the base element aperture (619) and is connected to the gas displacing piston (362). The tensioning element is capable of applying a tensioning force but is not capable of applying a compression force. The tensioning element is configured to exert a tension force on the gas displacing piston (362) when a free end of the tensioning element is pulled by a tensioning force. The tensioning element (606) is disposed to direct the tension force substantially opposed the spring biasing force such that when the tension force is increased it overcomes the spring biasing force and lifts the gas displacing piston toward the bottom end (83) of the expansion stroke.

The refrigeration device also includes a motive drive device disposed external to the gas expansion cylinder (364) and attached to the fee end of the tensioning element (606) for applying a tension force thereto. The motive drive device is configured to cyclically increase and decrease the tension force during each refrigeration cycle for driving movement of the gas displacing piston. Accordingly, the gas displacing piston is moved over the expansion stroke range (84) by increasing the tension force in the cable until the tensioning force overcomes the biasing force applied by the compression spring and the gas displacing piston (364) begins to move from the expansion stroke top end position (84) to the expansion stroke bottom end (85). When the tension for is decreased, the spring biasing force returns the gas displacing piston from the top end position (85) back to the bottom end position (83).

In a further aspect of the invention, a method for driving a gas displacing piston (364) for movement with respect to a gas expansion cylinder (364) is provided. The method includes a first step of biasing the gas displacing piston (362) toward a cold end of the gas expansion cylinder (364) by applying a compression spring biasing force against the gas displacing piston with the spring force directed toward the expansion cylinder cold end. In a second step the gas displacing piston (364) is advanced from the cold end toward the warm end using a tension force directed opposed to the spring biasing force. The tension force is applied when the tensioning element (606) is tensioned by a motive driving device (302) which may comprise a rotary motor configured with a motor shaft (320) that rotates eccentrically about a motor rotation axis (328).

In a further aspect of the invention, the refrigeration device may be configured to generate a pneumatic force inside the gas expansion space (380). The pneumatic force acts on the gas displacing piston (364) in a direction that substantially opposes the compression spring biasing force. In particular, when the pneumatic pressure inside the gas expansion space (380) exceeds a predetermined pressure threshold, the pneumatic force overcomes the spring biasing force and the tension force and advances the gas displacing piston (364) toward the expansion stroke bottom end position (83). This action causes the expansion stroke to be self tuning with occurrences of maximum gas pressure in the gas expansion space.

BRIEF DESCRIPTION OF THE DRAWINGS

The features of the present invention will best be understood from a detailed description of the invention and a preferred embodiment thereof selected for the purposes of illustration and shown in the accompanying drawing in which.

DETAILED DESCRIPTION OF THE INVENTION

Stirling Refrigeration Cycle

Figure 1:
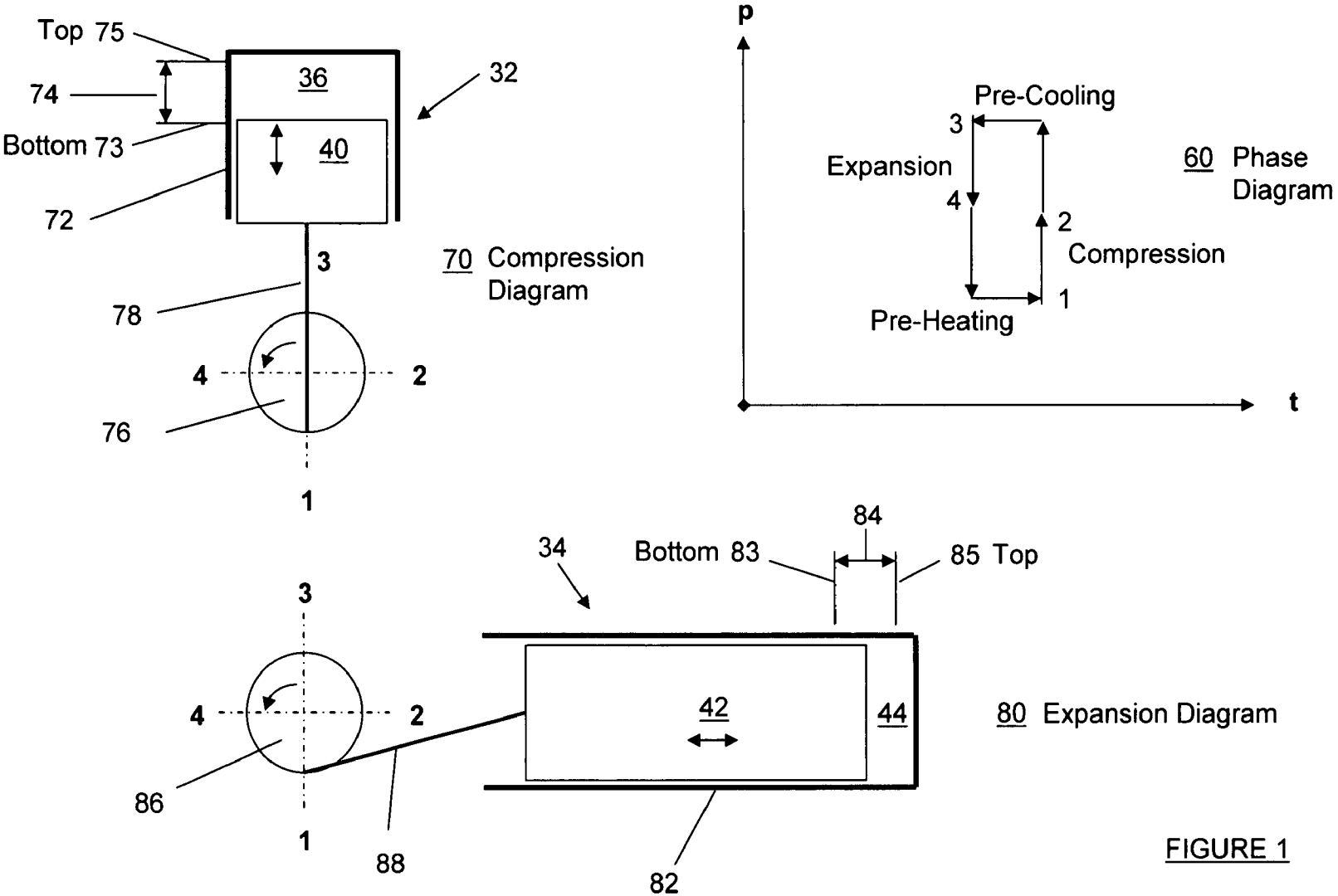
FIG. 1 depicts schematic diagrams illustrating the operating state and refrigeration fluid condition during each stage of a Stirling refrigeration cycle according to the present invention.

Referring to FIG. 1, a schematic diagram shows the operating stages of a Stirling refrigeration cycle in one example of a gas refrigeration device. The Stirling refrigeration cycle utilizes four process steps to cool a volume of refrigeration gas and the four process steps, when continuously repeated, deliver a steady state cooling power. FIG. 1 includes a phase diagram 60 which plots refrigeration gas pressure vs temperature during each step of the ideal Stirling refrigeration fluid cycle. Those skilled in the art will recognize that the fluid phase diagram 60 is a theoretical phase diagram used here merely to illustrate the process steps. Starting at the fluid pressure/temperature coordinates 1 the first "compression" stage is an isothermal increase in the fluid pressure shown as the transition from point 1 to point 2. The second "pre-cooling" stage is an isobaric decrease in the fluid temperature, shown as the transition from point 2 to point 3. The third "expansion" stage is an isothermal decrease in the fluid pressure, shown as the transition from point 3 to point 4. The fourth "pre-heating" stage is an isobaric increase in the fluid temperature, shown as the transition from point 4 to point 1. A compression diagram 70 and an expansion diagram 80 illustrate the movement of a gas compression piston inside an expansion cylinder 72 and a gas displacing piston inside a gas expansion cylinder 82 for each of the cycle steps 1-4.

Referring to the diagram 70 the compressor 32 includes the gas compression piston 40 movable within the compression cylinder 72. Movement of the compression piston 40 over the compression stroke varies the volume of a gas compression volume 36 and therefore the volume of the refrigeration device working volume and thereby increases the pressure of the refrigeration gas contained within the refrigeration working volume. A first drive coupling 78 is connected between the compression piston 40 and a point on a rotatable disk 76, which schematically represents a compressor drive system. Linear movement of the piston 40 over the compression stroke has a motion range 74 corresponding with 180° of angular rotation of the disk 76. The compression piston 40 starts the cycle at a bottom end position 73 when the drive link 78 is at the position 1. The compression piston 40 moves to a top end position 75 when the disk 76 is rotated 180° thereby placing the end of the drive link 78 at position 3. The compression stoke repeats during each refrigeration cycle with the compression piston 40 reciprocating between the bottom end position 73 and the top end position 75 along the linear motion axis defined by the compression cylinder. One refrigeration cycle corresponds with one full rotation of the disk 76. The angular velocity of the disk 76 corresponds to the cycle frequency.

Referring to the diagram 80, the gas expander 34 is shown with the gas displacing piston 42 movable within the expansion cylinder 82 and the movement of the displacing piston 42 varies the volume of a gas expansion space 44. A second drive coupling 88, connected between the displacing piston 42 and a point on a rotatable disk 86, schematically represents an expander drive system. Linear movement of the piston 42 over the expansion stroke has a motion range 84 corresponding with 180° of angular rotation of the disk 86. The displacing piston 42 starts the cycle at a mid-stroke position when the drive link 88 is at the position 1. The displacing piston 42 moves to a top end position 85 when the disk 86 is rotated 90°, thereby placing the end of the drive link 88 at position 2. The expansion stoke repeats during each refrigeration cycle with the gas displacing piston 42 reciprocating between the bottom end position 83 and the top end position 85 along the linear motion axis defined by the compression cylinder. One refrigeration cycle corresponds with one full rotation of the disk 86.

Generally the schematic example of FIG. 1 represents a mechanically or directly driven gas expander with the link 88 in continuous contact with the disk 86. In the example, the end of the compression stroke corresponds to the position 3 of disks 76 and 86. At position 3 the expansion stroke (movement from the mid-stroke point to the bottom end position 83) is just beginning. Accordingly the end of expansion stroke lags the end of the compression stroke by 90° of disk rotation.

External View

Figure 2:
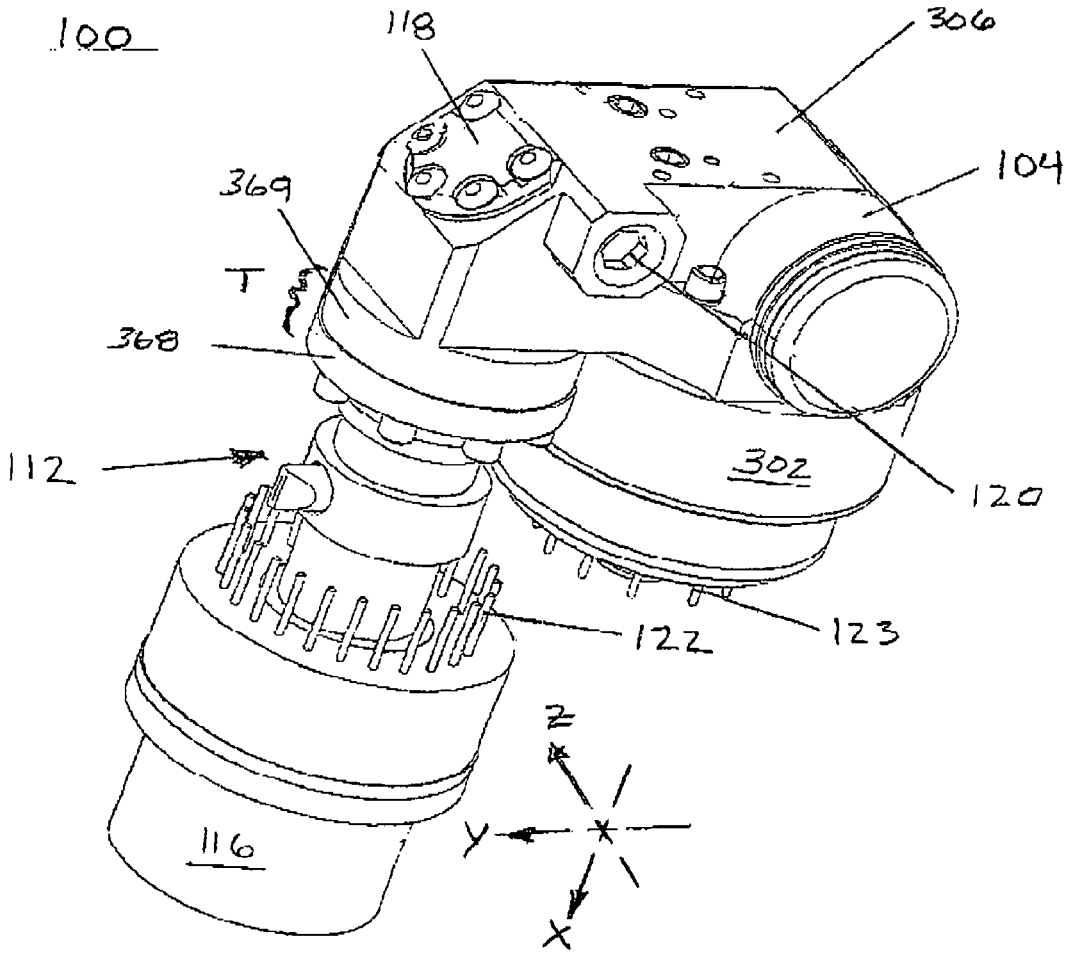
FIG. 2 illustrates an external view of a sensor assembly incorporating a cryocooler cable drive according to the present invention.

FIG. 2 depicts an external isometric view of a miniature radiation sensor assembly 100 that includes the miniature cryocooler configured with a tensioning element for driving the movement of a gas displacing piston according to the present invention described below. As shown, the sensor assembly 100 includes the DC motor 306 attached to the unitary crankcase 306. A gas compression unit, compressor 104 is configured to compactly incorporate within the crankcase 306. A gas volume expansion unit, expander, generally 112 attaches to the crankcase 306 by the mounting flanges 368 and 369, which include elements and features for forming a thermal barrier T approximately between the flanges. A Dewar assembly 116 is attached to the gas volume expansion unit 112, at its cold end, and encloses an infrared radiation sensor assembly, not shown, to be cooled. Access to elements inside the crankcase 306 is provided through an access port and associated cover, collectively 118. In addition, the crankcase 306 includes a purge port and associated cover, collectively 120, for injecting a refrigeration gas into the crankcase 306.

The entire crankcase 306, gas compression unit, DC motor 306, and gas volume expansion unit 112 are filled with a refrigeration gas, preferably comprising helium. Accordingly, the crankcase 306 and each element attached thereto is configured with gas tight pressure seals defined by interfacing mating surfaces, labyrinths and gasket seals and as may be required. The sensor assembly 100 also includes electrical connecting pins 122 exiting from the Dewer assembly 116 for interfacing with a signal processor, not shown, and electrical connector pins 123 exiting from the DC motor 306 for interfacing with a motor driver, not shown. As further shown in FIG. 2, a system coordinate system is depicted to identify three mutually perpendicular system coordinate axes X, Y and Z. The example embodiment of FIG. 2 is an integrated cryocooler that utilizes a single rotary DC motor 306 to provide a motive driving force for driving the compressor 104 and the expander 112. As will be further pointed out below, the present invention is also usable in a split cryocooler configuration.

Gas Compression Unit and the First Drive Coupling

Figure 3:
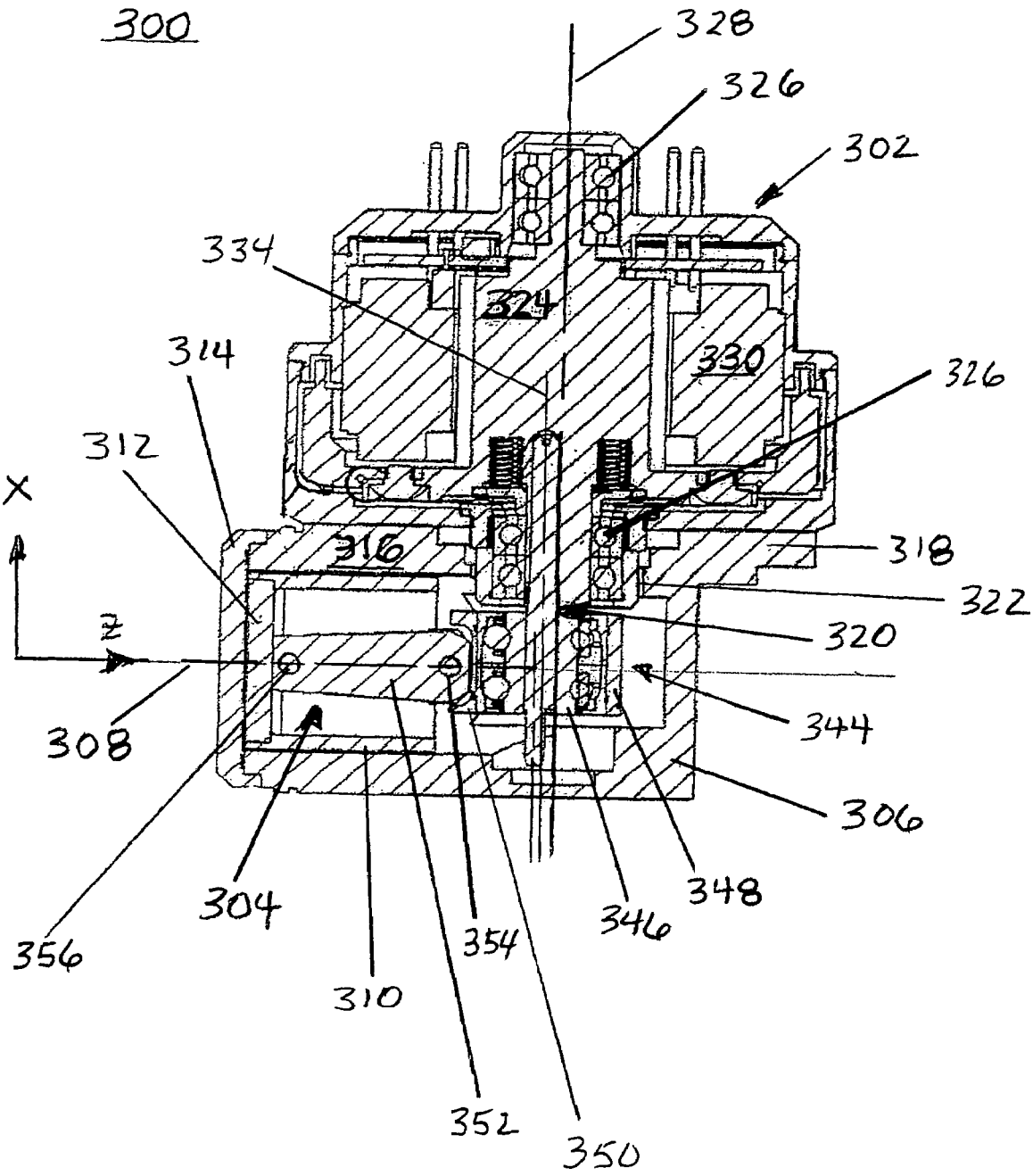
FIG. 3 illustrates a section view taken through a first drive coupling and rotary DC motor according to the present invention.
Figure 4:
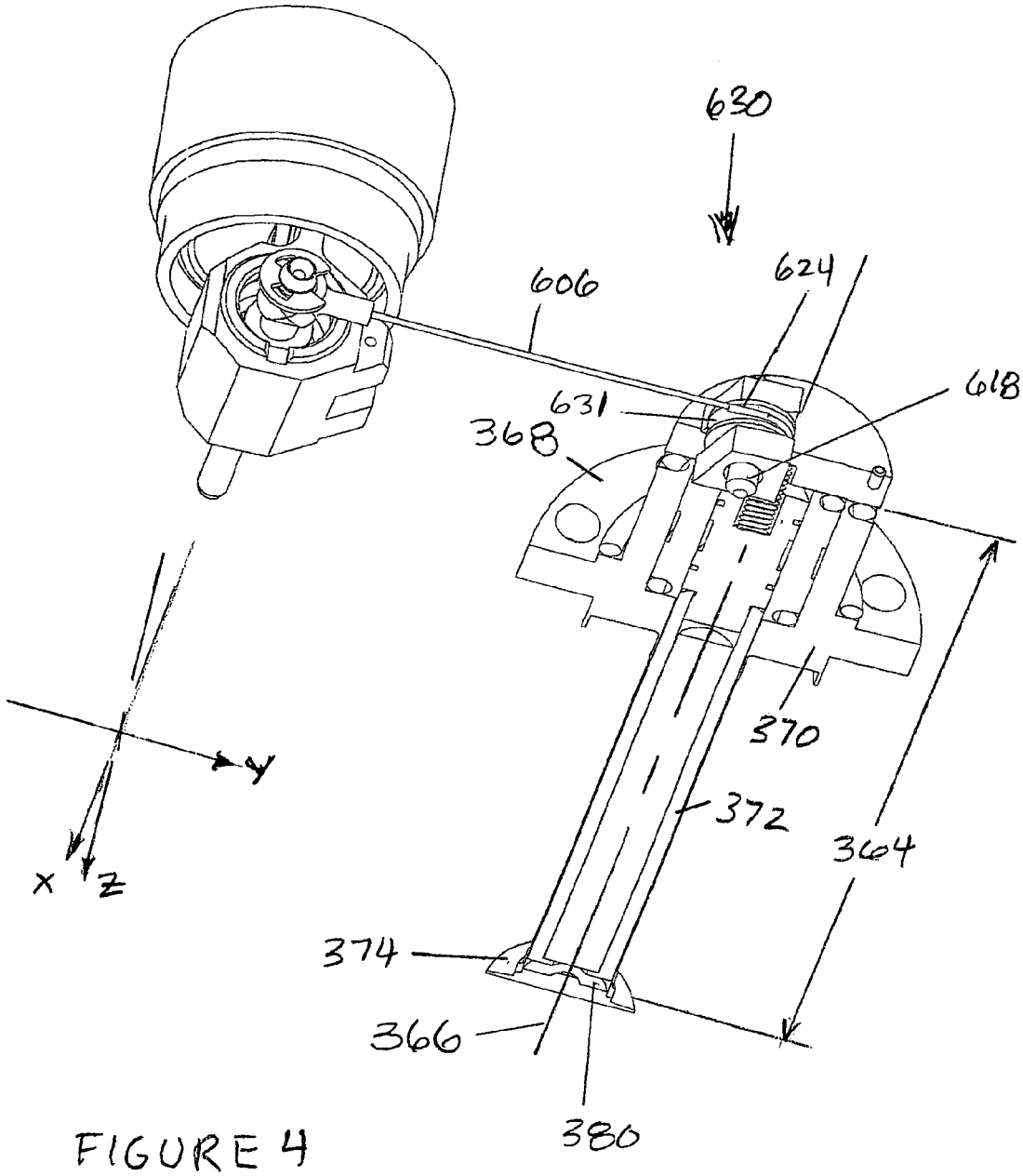
FIG. 4 further illustrates a first isometric cut-away view of a cryocooler configured with a second drive coupling according to the present invention.
Figure 5:
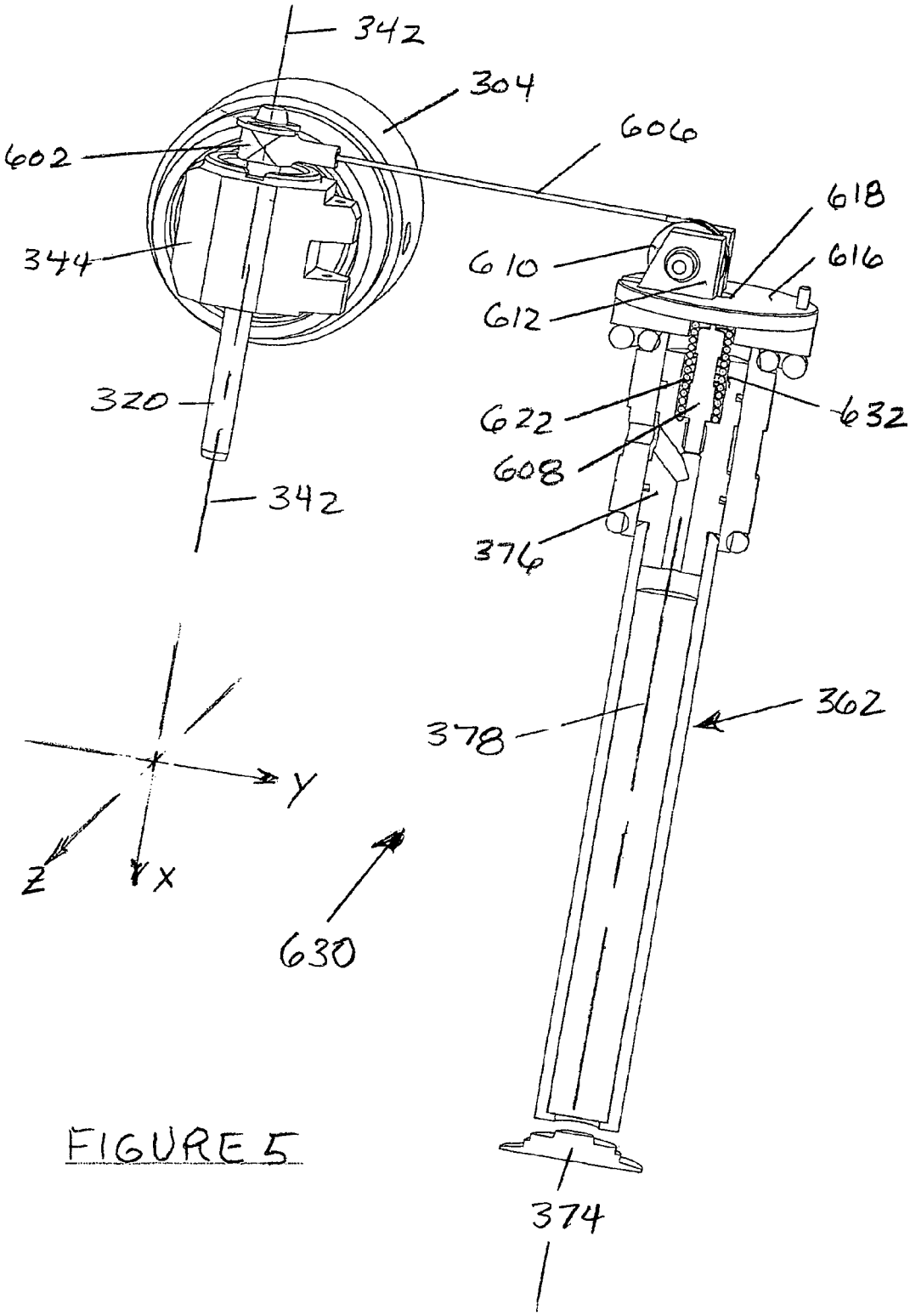
FIG. 5 illustrates a second isometric cut-away view of a cryocooler configured with a second drive coupling according to the present invention.

FIG. 3 is a section view through a gas compression unit, a rotary motor and a first drive coupling module coupled between the gas compression unit and the rotary motor in a system X-Z plane. As shown, a DC motor 302 includes a motor shaft 320 extending therefrom and coupled with a gas compression piston, generally identified by the reference numeral 304, by a first drive coupling. The gas compression piston 304 is movably supported within a gas compression cylinder formed in the body of a crankcase 306. The compression cylinder has a first longitudinal axis 308, which defines an arbitrary system Z coordinate axis. As shown in FIGS. 4 and 5, a gas expansion unit includes a gas expansion cylinder 364 with a second longitudinal axis 366 that is disposed parallel with the system X coordinate axis.

The gas compression piston 304 comprises an annular piston outer wall 310 and a circular cross-sectioned piston head 312, attached thereto. An outside diameter of the annular piston outer wall 310 and an inside diameter of the compression cylinder are form fitted to provide a gas clearance seal. The gas clearance seal prevents pressurized refrigeration gas from escaping from the compression cylinder, while still allowing movement of the gas compression piston 304 along the first longitudinal axis 308. The radial clearance of the gas clearance seal may be in the range of 0.001-0.0015 mm, (50-100 micro inches), or less, if it can be achieved by a practical process.

The gas compression cylinder is sealed at a high pressure end thereof by a head cover 314 attached to the crankcase 306. A cylindrical compression volume (36 in FIG. 1), is formed between the head cover 314 and the piston head 312 and movement of the gas compression piston 304 varies the volume of the compression volume to generate cyclic pressure pulses within the refrigeration gas contained within the working volume of the refrigeration device. A fluid conduit, (38 in FIG. 1), is in fluid communication with the compression volume 36 and allows refrigeration gas to flow bi-directionally in and out of the compression volume 36 in response to variation in its volume.

The crankcase 306 comprises a metal casting, e.g. steel or aluminum, and includes a solid annular surrounding wall 316 formed to house the gas compression cylinder and a motor supporting wall 318 for receiving the DC motor 302 mounted thereon. A drive end of the DC motor 302 includes the motor shaft 320 extending therefrom. The drive end and motor shaft install into the crankcase 306 through an aperture 322 in the supporting wall 318.

The DC motor 302 includes a rotor 324 supported by opposing rotary bearings 326 for rotation about a motor rotation axis 328. The DC motor 302 further includes a stator or armature assembly 330 configured with conductive windings formed therein. The rotor 324 includes permanent magnets supported thereon and the rotor 324 and stator 330 interact to generate an electromotive force for rotating the rotor at a substantially constant rotational velocity in response to an electrical drive current delivered to the stator conductive windings. One example of a preferred embodiment of the DC motor 302 is disclosed in co-pending and commonly assigned U.S. patent application Ser. No. 10/830,630, by Bin Nun et al., filed on Apr. 23, 2004, entitled REFRIGERATION DEVICE WITH IMPROVED DC MOTOR, the entire content of which is incorporated herein by reference.

Figure 7:
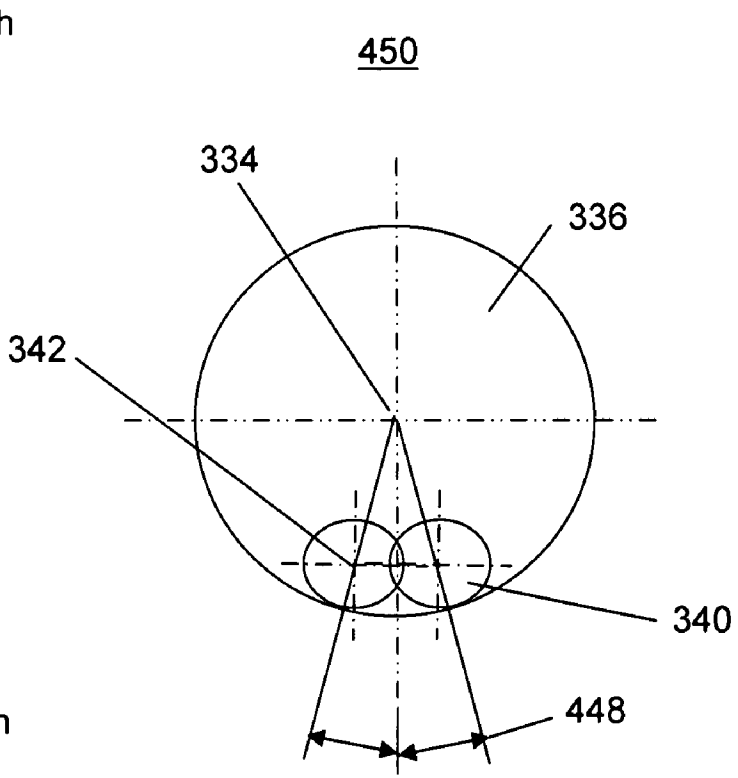
FIG. 7 illustrates an alternate embodiment of the orientation of the motor shaft second mounting feature according to an alternative embodiment of the present invention.
Figure 6:
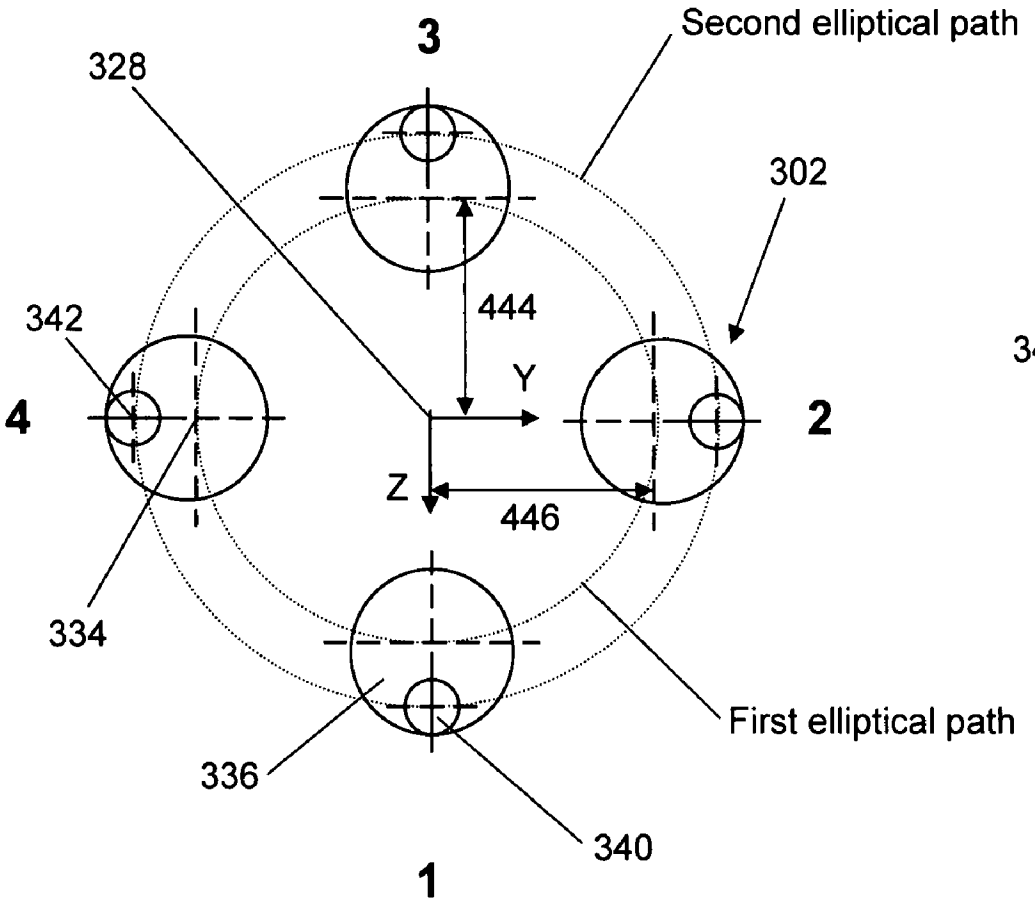
FIG. 6 depicts a schematic representation of a top view of the motor rotor and drive shaft in various stages of rotation according to the present invention.
Figure 8:
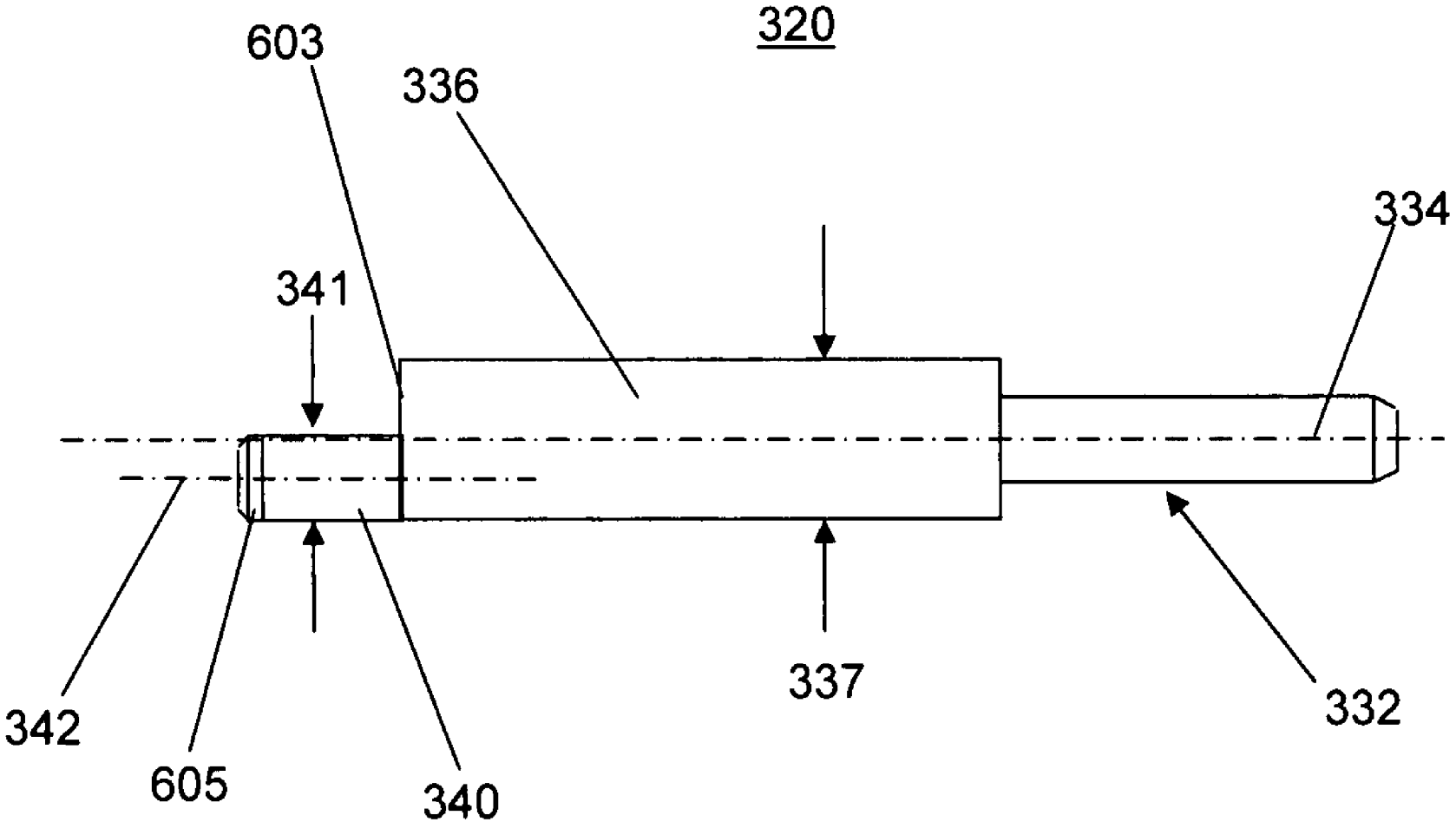
FIG. 8 illustrates a side view of a motor shaft according to the present invention.

The motor shaft 320 is fixedly attached to a motor rotor 324 and the shaft 320 is radially offset from the motor rotation axis 328 so it rotates eccentrically or circularly about the motor rotation axis 328. The motor shaft 320 is depicted in FIGS. 6-8. The motor shaft 320 includes a motor mounting feature 332 for fixedly securing the motor shaft 320 to the rotor 324. In the example motor shaft embodiment shown in FIG. 8 the mounting feature 332 is a cylindrical diameter having a longitudinal axis 334.

The motor shaft further includes a first mounting feature 336 used to interface with the first drive coupling module. In the example motor shaft of FIG. 8, the first mounting feature comprises a cylindrical diameter 337 having a third longitudinal axis 334. In the example embodiment, first mounting feature 336 and the motor mounting feature 332 have the same third longitudinal axis 334, however in other embodiments; the motor mounting feature 332 may have a different longitudinal axis offset from the third longitudinal axis 334. In either case, the motor shaft 320 attaches to the motor rotor 324 with its third longitudinal axis 334 radially offset from the motor rotation axis 328 so that rotation of the motor rotor 324 causes the third longitudinal axis 334 to traverse a first eccentric path around the motor rotation axis 328 as the rotor rotates. The first eccentric path may be circular or elliptical. The first mounting feature 336 interfaces with the first drive coupling to drive the gas compression piston 304 with a reciprocal linear motion.

The motor shaft 320 further includes a second mounting feature 340 extending longitudinally from the first mounting feature 336 and formed with a second diameter 341 and a fourth longitudinal axis 342. The fourth longitudinal axis 342 is disposed radially offset from the motor rotation axis 328 and is also radially offset from the third longitudinal axis 334 so that rotation of the motor rotor 324 causes the fourth rotation axis 328 to traverse a second eccentric path around the motor rotation axis 328 as the rotor rotates. The second eccentric path may be circular or elliptical. The second mounting feature 340 interfaces with a second drive coupling to drive gas displacing position 362 with a reciprocal linear motion.

The first drive coupling module comprises a duplex bearing set 344 rotatably attached to the first mounting feature 336. The bearing set 344 includes paired inner races 346 fixedly attached, e.g. by a press fit, onto the first mounting feature 336. The bearing set 344 also includes paired outer races 348, supported for rotation with respect to the paired inner races 346. The paired outer races 348 are configured with an attaching element 350 for attaching the outer races 348 to a flexible vane drive link 352. The flexible vane drive link 352 includes an input end configured to attach to the attaching element 350 and an output end configured to attach to the gas compression piston at the piston head 312. The attaching element 350 is fixedly attached to the paired outer races 348 and may include a pin used to align and transfer driving forces from the attaching element to the link input end. The attaching element 350 may also include a clamp, not shown, for securing the input end of the drive link 352 thereto. The duplex bearing set 344 minimizes mechanical play between the paired inner and outer races to reduce noise and vibration, to stiffen the first drive coupling, and to reduce bearing wear. However, a single rotary bearing or a bushing is also usable without deviating from the present invention.

The flexible vane link 352 comprises a bendable leaf spring. The leaf spring has a longitudinal axis that extends from the input end to the output end. The leaf spring comprises a thin layer of spring steel or other suitable flexure material having a thickness dimension orthogonal to its longitudinal length and a width dimension orthogonal to the thickness dimension and to the longitudinal length. The thickness dimension is selected to allow repeated bending of the link without permanent deformation. In the example shown in FIG. 3, the thickness dimension is orthogonal to the X and Z axes, the width extends along the X-axis and the longitudinal length extends along the Z-axis. The leaf spring is bendable in response to forces applied in the Y direction e.g. by Y-axis motion components of a drive force delivered to the input end.

In the example of FIG. 3, the leaf spring is formed with a buckle resistant shape by providing a tapered width, with the input end having a wider width than the output end. This causes bending to start at the output end. Specifically, the width of the input end is approximately 5.8 mm, (0.23 inches), the width of the output end is approximately 4.3 mm, (0.17 inches) and the longitudinal length of the leaf spring is approximately 14.6 mm (0.575 inches). The drive link 352 further includes through holes 354, at the input end, and 356, at the output end, provided to attach the input end to the attaching element 350 and to attach the output end to the piston head 312. Pins installed through the holes 354 and 356 attach the link 352 to the attaching element 350 and to the piston head 312 and serve to align the link 352 and to transfer the driving forces generated by movement of the first mount feature 336 to the link input end and to transfer drive forces generated by movement of the link output end to the gas compression piston head 312. Clamps, not shown, may also be provided to secure the input and output ends of the link 352 to the attaching element 350 and piston head 312 respectively.

During each rotation of the motor rotor 324, the motor shaft traverses an eccentric path around the motor rotation axis 328 causing each of the first and second mounting features to move through a different eccentric path around the motor rotation axis 328. Accordingly, the first mounting feature 336 and its third longitudinal axis 334 traverse a first eccentric path around the motor rotation axis 328 causing the duplex bearing set 344 to move through the first eccentric path and to drive the input end of the flexible vane link 352 over the first eccentric path. The first eccentric path may comprise an elliptical path or a circular path around the motor rotation axis 328. Similarly, the second mounting feature 340 and its fourth longitudinal axis 342 traverse a second eccentric path around the motor rotation axis 328 causing the second mounting feature to drive an input end of a second drive coupling, described below, over the second elliptical path, which may also comprise an elliptical path or a circular path.

In particular, each of the first and second mounting features is moved through a different eccentric path around the motor rotation axis 328 and the motion of each mounting feature includes a component of reciprocating linear translation directed along the Z-axis and along the Y-axis. In the case of the first mounting feature 336 a Z-axis component of reciprocating linear motion is transferred to the gas compression piston 304 along the longitudinal axis of the flexible drive link 352 and drives the gas compression piston 304 through the stroke motion range 74 from the top end 75 to the bottom end 73, as shown in FIG. 2. In FIG. 3, the piston head 312 is shown at the top end position 75. As is best understood from FIG. 6, when the piston head 312 is in the top end position, (position 3 in FIGS. 2 and 6), the third longitudinal axis 334 is opposed to the motor rotation axis 328 in a negative Z direction. When the piston head 312 is in the bottom end position 73, (position 1 in FIGS. 2 and 6), the third longitudinal axis 334 is opposed to the motor rotation axis 328 in the positive Z direction. Accordingly, the piston head 312 is moved from the top end position 75 to the bottom end position 73 by 180° of motor shaft rotation.

The first mounting feature 336 is also driven by a Y-axis component of reciprocating linear motion which is transferred to the input end of the flexible drive link 352 but merely bends the flexible drive along its longitudinal length. As is best viewed in FIG. 6, a maximum amplitude Y-axis component of the first mounting feature occur at positions 2 and 4 or 90° out of phase with the top and bottom end positions of the piston head 312.

Gas Expansion Unit and the Second Drive Coupling

A second drive coupling module shown in FIGS. 4 and 5 attaches at its input end to the DC motor shaft second mounting feature 340, extending along the third longitudinal axis 342, and extends therefrom to a gas displacing piston, generally indicated by the reference numeral 362. The gas displacing piston 362 installs into a gas expansion cylinder 364 along a longitudinal axis 366. The cylinder 364 is opened at a warm end thereof for receiving the gas displacing piston 362 therein, and closed and sealed at a cold end thereof by an end cap 374. The warm end attaches to the crankcase 306 at a flange 368. The cold end is cantilevered away from warm end to thermally isolate the cold end therefrom.

The gas expansion cylinder 364 is formed by a pressure sealed vessel comprising a first tube element 370, joined together with a second tube element 372. An end cap 374 is joined together with the second tube element 372 to form a closed end. The gas displacing piston 362 includes a fluid control module 376 at its warm end and a thermal regenerator module 378 extending from the warm end to the cold end. Each of the fluid control module 376 and the regenerator module 378 is formed as a fluid conduit that provides a fluid flow path along its longitudinal length. Refrigeration gas enters the expansion cylinder 364 through the first tube element 370 and flows through the fluid control module 376, the thermal regenerator module 378, and into a gas expansion space 380. The gas expansion space 380 comprises a hollow volume of the gas expansion cylinder 364 formed between the regenerator module 378 and the end cap 374.

The open end of the expansion cylinder 364 is sealed by a gas clearance seal formed by the interface between the fluid control module 376 and the first tube element 370. The gas clearance seal prevents pressurized refrigeration gas from escaping through the open end of the expansion cylinder 364, while still allowing longitudinal movement of the gas displacing piston 370 along the longitudinal axis 366. The radial clearance of the gas clearance seal may be in the range of 0.001-0.0015 mm, (50-100 micro inches), or less, if it can be achieved by a practical process. Each of the first tube 370, second tube 372 and the end cap 374 comprises steel or another metal substrate selected for its formability, high stiffness and welding properties. Preferably the elements of the pressure vessel are attached together by a laser weld which provides an excellent sealing joint for high pressure applications.

The gas displacing piston 362 has a longitudinal length sized to fill the expansion cylinder 364 except for the gas expansion space 380. Reciprocal movement of the gas displacing piston 362 along the longitudinal axis of the cylinder 364, over the expansion stroke range cyclically varies the volume of the gas expansion space 380. As described above, the expansion stroke expands the volume of the gas contained with the expansion space 380 to generate cooling power. When the piston movement reverses, during the pre-heating stage of the refrigeration cycle, the volume of the expansion space 380 is decreased and refrigeration gas is expelled from the expansion space and forced to flow into the regenerator module 378 and back toward the gas compression unit.

The second drive coupling is configured as a cable drive, shown in isometric cutaway view in FIGS. 4 and 5 and the motor shaft is shown in side view in FIG. 8. The second drive coupling attaches at an input end thereof to the motor shaft second attaching feature 340, which is centered by the fourth longitudinal axis 342. The second drive coupling receives its drive input from the movement of the second mounting feature 340 as it traverses the second elliptical path. The second drive coupling input end is formed as an input coupling 602 for rotatably attaching to the second mounting feature 340. The input coupling 602 may comprise an annular body with a bore formed there through for mating with the second mounting feature diameter 341 with a slight clearance fit to allow rotation of the diameter 341 with respect to the coupling 602. The input coupling 602 may be captured between a shoulder 603 formed at a base of the second mounting feature diameter 341 and a clip ring 604, that is mechanically held within a groove 605 formed at the end of the second mounting feature diameter 341.

A tension element, e.g. a flexible cable 606, is fixedly attached to the input coupling 602, such as by a crimping element, and extends therefrom to a gas expansion unit, generally 630, for attaching to the gas displacing piston 362. The cable 606 extends from the input coupling 602 to an attaching element 608 at its output end and may be formed from braided metal wire or from other woven or braided strands. Alternately, the tension element may comprise a single strand wire. The attaching element 608 is fixedly attached to a fluid control module 376 of gas displacing piston 362. The gas displacing unit 630 includes a support base 616 disposed over the open warm end of the gas expansion cylinder 364 and attached to the first tube 370. The support base 616 includes a clevis shaped support element 612 extending therefrom. The support element 612 supports a pulley 610 for rotation with respect to the clevis support element 612 and the cable 606 wraps around the pulley 610 which guides the cable 606 through a substantially 90° bend. The pulley 610 is a disk shaped element formed with an axial bore, not shown, through a center axis and with its circumferential edge being formed with a grooved or other guiding feature 631 for supporting and or guiding the cable 606 over the pulley 610. In addition, the cable 606 may include a wear resistant sleeve 624 wrapped around the cable 606 in the region where the cable is in contact with the pulley 610.

The clevis shaped pulley support 612 includes opposing clevis elements that extend up from the support base 616 and capture the pulley 610 there between. A pin 618 extends through each of the clevis elements and through the axial pulley bore to provide a rotation axis for the pulley 610 and the pulley rotates in response to longitudinal movement of the cable 606. The pin 618 is fixedly attached to one of the clevis elements, e.g. by a threaded engagement. Alternately, the pulley may be non-rotatably supported with respect to the clevis support 612 such that the cable slides over the circumference of the pulley 610. The support base 616 is a disk shaped element that includes a center aperture 618 passing there through for providing access for the cable 606 to enter into the gas expansion cylinder 364.

The attaching element 608 is fixedly attached to the fluid control module 376 and to the cable 606. A compression spring 622 installs between the fluid control module 376 and the support base 616. The fluid control module 376 includes an axial bore 632 formed to receive the attaching member 608 and the spring 622 therein. The spring 622 surrounds the attaching member 608 and is captured in the axial bore 632. The spring 622 provides a compression force that nominally biases the position of the gas displacing piston 362 toward the end cap 374. Thus the spring 622 forces the gas displacing piston to its top end position indicated as 85 in FIG. 1.

In operation, rotation of the motor rotor 324 causes the second mounting feature 340 and the input coupling 602 to traverse the second eccentric path around the motor rotation axis 328. Each rotation of the motor shaft 320 causes the fourth longitudinal axis 342 to traverse the second eccentric path around the motor rotation axis 328. Accordingly, the input coupling 602 and the input end of the cable 606 follows the second eccentric path.

The second eccentric path may be divided into two perpendicular components of linear translation, which in the case of the second eccentric path comprise a component of linear translation along the Y-axis and a perpendicular component of linear motion along the Z-axis. The Y-axis motion alternately varies the tension on the cable 606 along its longitudinal axis. The Z-axis component of linear motion merely bends the cable about a pivot axis located where the cable meets the pulley 610.

As the tension generated in the cable 606 along its longitudinal axis is varied, the cable pulls on the attaching element 608. When the amplitude of the cable tension is below the biasing force applied by the compression spring 622 the gas displacing piston remains biased at it top end position 85 in FIG. 2. As the tension on the cable increases the biasing force is overcome by the tensioning force and tension force begins to move, (pull), the gas displacing piston along the second longitudinal axis (366), i.e. in the system negative X-direction. In a preferred embodiment, the tension force applied to the cable 606 keeps the cable snug during the entire cycle of movement of the input coupling 602 over the second eccentric path, however, in other embodiments the cable 606 may become slack during part of the refrigeration cycle.

Referring to FIG. 6, the cable tension has minimum tension amplitude when the motor rotor is at the angular position 2, i.e. when the gas displacing piston is at the top end position 85. Alternately, the cable tension reaches maximum tension amplitude when the motor rotor is at the angular position 4, i.e. when the gas displacing piston is at the bottom end position 83.

As is further realizable from FIGS. 1 and 6, the compression stoke starts at rotor position 1 and ends at rotor position 2 and the expansion stroke starts at rotor position 3 and ends at rotor position 4. Accordingly, the expansion stroke start lags the compression stroke end by a phase angle of 90° of angular rotation of the rotor. Alternately, FIG. 7 shows that the motor shaft can be configured with the location of the second mounting feature 340 advanced or retarded by the angle 448 to adjust the phase angle between the expansion stroke start and the compression stroke end. Generally phase angle in the range of 75° to 105° may be used to optimize system performance. The correct phase angle for a particular cryocooler design may be determined by measuring the system output with different phase angles.

Similarly, the performance of the cryocooler may be enhanced by changing the length of one or both of the compression and expansion strokes. According to a further aspect of the present invention, the length of the expansion stroke 74 can be adjusted independently of the length of the compression stroke 84 by changing the configuration of the DC motor 302. In particular, the length of the expansion stroke 74 is dependent upon the separation 444 between the longitudinal axis 332 and the motor rotation axis 328 along the Z-axis. Similarly, the length of the expansion stroke 84 is dependent upon the separation 446 between the longitudinal axis 342 and the motor rotation axis 328 in the Y-axis. Accordingly, the stroke lengths are independent with each stroke length being variable according to a different change in the configuration of the DC motor 302. Thus according to one aspect of the present invention, a single cryocooler device may be reconfigured to perform differently by changing the DC motor 302. As an example, one or both of the stroke lengths and the phase angle between the motions of the pistons can optimized for different applications by installing a different DC motor configuration.

The cable actuator of the present invention provides a low cost alternative to mechanical linkages and direct drive options for driving an expander. Moreover, the cable actuator of the present invention is operable in two modes. Specifically, when the spring biasing force is high enough, movement of the gas displacing piston is completely dictated by the opposing spring compression force and cable tensioning forces such that the instantaneous position of the gas displacing piston is dictated by the drive profile of the second elliptical path which is repeatable for each refrigeration cycle. In this operating mode, the cable actuator operates like a mechanical linkage drive but is less costly, less noisy and more reliable that a mechanical linkage drive because the cable actuator has fewer parts, is simpler to assemble and manufacture and reduces mechanical play.

In a second embodiment of the cable drive a weaker compression spring 622 generates a reduced spring force. In this mode of operation the reduce spring force is more easily overcome by the tension force applied by the cable 606 and is further overcome by a pneumatic force generated by refrigeration gas contained with the gas expansion space 380 and acting on the gas displacing piston. In particular, the gas displacing piston 362 is acted upon by pneumatic forces generated at each end thereof. Specifically, when the refrigeration gas pressure amplitude inside the gas expansion space 380, (cold end) is increased above the refrigeration gas press amplitude at the piston warm end, a pneumatic force directed opposed to the spring compression force and adds to the cable tension force acts on the gas displacing piston 362. If the magnitude of the spring biasing force is low enough, the pneumatic force, in combination with the cable tension force may overcome the spring force and move the gas displacing position toward its bottom end position 83. Accordingly, the expander can be made to be self-tuning when the force of the compression spring 622 is overcome by the combination of the tension force applied by the cable 606 and the pneumatic force generated by refrigeration gas contained within the gas expansion space.

Thus according to the second embodiment of the cable drive, the compression spring 622 applies a spring biasing force that overcome by a pneumatic force generated when the refrigeration gas pressure amplitude inside the gas expansion volume 380 exceeds a threshold pressure amplitude. In this embodiment, the gas displacing piston precisely follows the input drive movement profile set forth by the movement of the cable input coupling 602 for a first portion of the refrigeration cycle and follows a drive movement profile set forth by pneumatic forces generated inside the gas expansion space during a second portion of the refrigeration cycle. More specifically, the gas displacing piston follows the movement profile set forth by the pneumatic forces whenever the refrigeration gas pressure exceeds pressure amplitudes capable of generating pneumatic forces that exceed the biasing force applied by the compression spring 622. In this embodiment the expander is self-tuning.

One advantage of the self-tuning expander described above is that the expander phase relationship with the compression stroke is dependent upon the refrigeration gas pressure inside the gas expansion space. If during any operating period the refrigeration gas pressure inside the expansion space does not exceed a threshold gas pressure required to overcome the spring biasing force, the expander will operate according to a standard compression stroke to expansion stroke phase lag e.g. 90°. However, if during other operating periods the refrigeration gas pressure inside the expansion space exceeds the threshold gas pressure amplitude the phase or the expansion stroke will vary in accordance with the instantaneous gas pressure amplitude inside the expansion space such that the expansion stroke will be self-tuning.

In a further advantage of the self-tuning expander described above is that the use of pneumatic force generated by the refrigeration gas to overcome the spring biasing force and to move the gas displacing piston actually reduces the enthalpy of the refrigeration gas and this generates additional cooling power. Thus there are two benefits to the invention. One is to tune the phase of movement of the expansion stroke to peak pressure pulse occurrences, which increases the refrigeration efficiency, and the second is to lower the enthalpy of the gas to thereby generate more cooling power.

It will also be recognized by those skilled in the art that, while the invention has been described above in terms of preferred embodiments, it is not limited thereto. Various features and aspects of the above described invention may be used individually or jointly. Further, although the invention has been described in the context of its implementation in a particular environment, and for particular applications, e.g. a miniature Stirling cycle cryocooler, those skilled in the art will recognize that its usefulness is not limited thereto and that the present invention can be beneficially utilized in any number of environments and implementations including but not limited to any refrigeration system. Accordingly, the claims set forth below should be construed in view of the full breadth and spirit of the invention as disclosed herein.

The invention claimed is:

1. A gas refrigeration device operating on a gas refrigeration cycle comprising:

a gas expansion cylinder (364) formed to receive a gas displacing piston (362) movably supported therein for movement over a stroke range (84) and formed with an open warm end and an opposing sealed cold end;

a base element (616) disposed over the open warm end and formed with an aperture (618) passing therethrough for providing access to the gas expansion cylinder;

a gas expansion space (380) formed between the sealed cold end and the gas displacing piston (362) for receiving refrigeration gas therein and further wherein the volume of the gas expansion space (380) is variable from a minimum volume, when the gas displacing piston (362) is at a top end (85) of the stroke range (84), to a maximum volume, when the gas displacing piston (362) is at a bottom end (83) of the stroke range (85);

a compression spring (622) disposed between the base element (616) and the gas displacing piston (362) for exerting a spring biasing force against the gas displacing piston (362) for forcing the gas displacing piston to the top end (85)of the stroke range; and, a tensioning element (606) passing through the aperture (619) and connected to the gas displacing piston (362) for exerting a tension force on the gas displacing piston (362) directed substantially opposed to the spring biasing force.

2. The gas refrigeration device of claim 1 further comprising a motive drive device disposed external to the gas expansion cylinder (364) and attached to the tensioning element (606) for applying a variable tension force to the tensioning element (606).

3. The gas refrigeration device of claim 2 wherein the motive drive device is operable to increase the tension force to overcome the spring biasing force and to continuously advance the gas displacing piston (362) from the top end position (85) to the bottom end position (83) during a precooling and an expansion stage of the gas refrigeration cycle and to decrease the tension force to a force that is less than the spring biasing force during a preheating and a compression stage of the gas refrigeration cycle.

4. The refrigeration device of claim 3 wherein the motive drive device comprises a rotary motor (302) configured with an motor rotor (324) rotating about a motor rotation axis (328) with a motor shaft (320) extending longitudinally therefrom and configured with a second mounting feature (340) radially offset from the motor rotation axis (328) for traversing a second elliptical path and further wherein an input end of the tensioning element (606) is attached to the second mounting feature (340) and traverses along the second elliptical path.

5. The refrigeration device of claim 1 wherein the tensioning element comprised a braided wire cable.

6. The refrigeration device of claim 5 further comprising a disk shaped pulley (610) supported with respect to base element (616) for guiding the cable through a substantially 90° bend and directing the cable through the aperture (618).

7. The refrigeration device of claim 6 wherein the pulley (610) is formed with a circumferential cable guiding feature (631).

8. The refrigeration device of claim 6 wherein the cable includes a wear resistant sleeve (624) wrapped around the cable (606) in the region where the cable is in contact with the pulley (610).

9. The refrigeration device of claim 7 wherein the pulley (610) is rotatable with respect to the base clement (616).

10. The refrigeration device of claim 4 further comprising:

a gas compression cylinder (310) in fluid communication with the gas expansion cylinder (364);

a gas compression piston (304) movably supported within the gas compression cylinder (310);

a first drive coupling comprising and output end coupled to the gas compression piston (304) and an input end (344); and, wherein the motor shaft (320) is further configured with a first mounting feature (336) positioned radially offset from the motor rotation axis (328) for traversing a first elliptical path and further wherein the first drive coupling input end (344) is attached to the first mounting feature (340) and traverses along the first elliptical path.

11. The gas refrigeration device of claim 1:

wherein the compression spring (622) generates biasing force amplitude;

wherein the refrigeration gas received into the gas expansion space (380) exerts an instantaneous pneumatic force against the gas displacing piston (362) in proposition to the instantaneous gas pressure amplitude in the gas expansion space (380) and directed opposed to the biasing force; and, wherein the biasing force is selected to ensure that the instantaneous pneumatic force amplitude exceeds the biasing force amplitude when the instantaneous gas pressure amplitude exceeds a predetermined threshold amplitude value.

12. A method for driving a gas displacing piston for movement over a stroke range (84) with respect to a gas expansion cylinder (364) during a gas refrigeration cycle comprising the steps of:

biasing the gas displacing piston (362) toward at a top end (85) of the stroke range corresponding with minimizing the a gas expansion space (44, 380) at a cold end of the gas expansion cylinder (364) by applying a spring biasing force against the gas displacing piston and, advancing the gas displacing piston (362) from the top end (85) of the stroke range to a bottom end (83) of the stroke range using a tension force directed opposed to the spring biasing force.

13. The method of claim 12 further comprising the step of generating a pneumatic force inside the gas expansion cylinder (364) and directed opposed to the spring biasing force for acting on the gas displacing piston in addition to the tension force.

14. The method of claim 13 wherein the pneumatic force is generated by refrigeration gas contained inside a gas expansion space (380) further comprising the step of causing the pneumatic force to exceed the spring biasing force each time a threshold gas pressure amplitude is exceeded in the expansion space (380).

15. A method for operating a gas refrigeration device formed by a working volume filled with a refrigeration gas comprising the steps of:

driving a gas compression piston (304) over a compression stoke for generating a once per refrigeration cycle peak gas pressure amplitude pulse in the working volume;

applying a compression spring biasing force against a gas displacing piston (362), movably disposed in a gas expansion cylinder (364), for biasing the gas displacing piston to a top end position (85) of a stroke range (84), said top end position minimizing a volume of a gas expansion space (380); and, applying a tension force on the gas displacing piston (362) directed opposed to the compression spring biasing force for overcoming the compression spring biasing force and advancing the gas displacing piston (362) to a bottom end position (83) of the stroke range (84), to thereby maximizing the volume of the gas expansion space (380).

16. The method of claim 15 wherein the step of driving the gas compression piston over a compression stroke and the step of applying a tension force on the gas displacing piston (362) are each performed by causing a motor shaft (320) to transverse an elliptical path around a motor rotation axis (328).

17. The method of claim 16 wherein the motor shaft is configured with a first mounting feature for traversing a first elliptical path around the motor rotation axis (328) and a second mourning feature (340) for traversing a second elliptical path around the motor rotation axis (328) and further comprising the steps of:

coupling the gas compression piston to the first mounting feature (336) for driving the gas compression piston in accordance with movement along the first eccentric path; and, coupling the gas displacing piston (362) to the second mounting feature for driving the gas displacing piston in accordance with movement along the second eccentric path.

18. The method of claim 15 further comprising the step of applying a pneumatic force on the gas displacing piston (362), said pneumatic force being generated by refrigeration gas contained within the gas expansion space (380) and directed opposed to the compression spring biasing force for adding to the tension force and acting on the gas displacing piston during the expansion stroke to overcome the compression spring biasing force when the gas pressure of the refrigeration gas inside the gas expansion space exceeds a gas threshold pressure amplitude.

* * * * *